US011401017B2

(12) United States Patent
Gamberini et al.

(10) Patent No.: US 11,401,017 B2
(45) Date of Patent: Aug. 2, 2022

(54) MASK FOR UNDERWATER USE, IN PARTICULAR OF THE FULL FACE TYPE, PROVIDED WITH A COMMUNICATION DEVICE

(71) Applicant: MESTEL SAFETY S.R.L., Milan (IT)

(72) Inventors: Sergio Gamberini, Genoa (IT); Gabriele Cucchia, Genoa (IT)

(73) Assignee: MESTEL SAFETY S.R.L., Milan (IT)

( * ) Notice: Subject to any disclaimer, the term of this patent is extended or adjusted under 35 U.S.C. 154(b) by 404 days.

(21) Appl. No.: 16/051,956

(22) Filed: Aug. 1, 2018

(65) Prior Publication Data

US 2019/0039702 A1 Feb. 7, 2019

(30) Foreign Application Priority Data

Aug. 3, 2017 (IT) ..... 102017000090078

(51) Int. Cl.

| | |
|---|---|
| ***H04B 11/00*** | (2006.01) |
| ***B63C 11/26*** | (2006.01) |
| ***B63C 11/16*** | (2006.01) |
| ***B63C 11/12*** | (2006.01) |

(52) U.S. Cl.

CPC ..... *B63C 11/26* (2013.01); *B63C 11/12* (2013.01); *B63C 11/16* (2013.01); *B63C 2011/165* (2013.01)

(58) Field of Classification Search

None

See application file for complete search history.

(56) References Cited

U.S. PATENT DOCUMENTS

| | | | | | |
|---|---|---|---|---|---|
| 3,218,607 | A * | 11/1965 | Brock | H04M 1/05 | 367/132 |
| 5,136,555 | A * | 8/1992 | Gardos | B63C 11/12 | 367/132 |
| 5,579,284 | A * | 11/1996 | May | H04B 13/02 | 367/132 |
| 5,586,176 | A * | 12/1996 | Peck | H04B 1/385 | 367/132 |
| 5,606,967 | A * | 3/1997 | Wang | B63C 11/16 | 128/200.29 |
| 5,642,529 | A * | 7/1997 | Fujima | B63C 11/12 | 2/428 |
| 5,706,251 | A * | 1/1998 | May | H04R 1/14 | 367/132 |
| 5,793,855 | A * | 8/1998 | Peck | H04B 1/385 | 367/132 |
| 6,061,457 | A * | 5/2000 | Stockhamer | H04R 1/00 | 367/140 |
| 6,430,298 | B1 * | 8/2002 | Kettl | A62B 18/08 | 381/361 |

(Continued)

FOREIGN PATENT DOCUMENTS

| | | | | |
|---|---|---|---|---|
| EP | 3437984 A1 * | 2/2019 | ..... | B63C 11/26 |
| FR | 2720050 A1 * | 11/1995 | ..... | B63C 11/16 |

(Continued)

*Primary Examiner* — Isam A Alsomiri
*Assistant Examiner* — Jonathan D Armstrong
(74) *Attorney, Agent, or Firm* — Fox Rothschild LLP

(57) ABSTRACT

This disclosure describes a full-face type mask for underwater use. The mask is provided with a mouthpiece to enable the wearer to breathe with his/her head under the surface of the water. The mask is also provided with a communication device.

8 Claims, 3 Drawing Sheets

(56) References Cited

U.S. PATENT DOCUMENTS 6,837,240 B1 * 1/2005 Olstad ..... B63C 11/02 128/201.27
7,310,063 B1 * 12/2007 Brown ..... B63C 11/205 128/201.11
7,477,207 B2 * 1/2009 Estep ..... B63C 11/26 345/8
9,047,873 B2 * 6/2015 Schuck ..... A62B 9/006
D851,751 S * 6/2019 Thomas ..... D24/110.1
D859,642 S * 9/2019 Xiong ..... D24/110.2
D860,436 S * 9/2019 Chen ..... D24/110.2
D869,639 S * 12/2019 Liao ..... D24/110.2
D869,641 S * 12/2019 Sang ..... D24/110.2
D875,923 S * 2/2020 Cai ..... D24/110.2
D878,547 S * 3/2020 Hu ..... D24/110.2
2002/0176323 A1 * 11/2002 Magine ..... H04B 13/02 367/134
2003/0082987 A1 * 5/2003 Baumgartner ..... A63H 30/04 446/175
2005/0206791 A1 * 9/2005 Kurth ..... H04M 3/308 348/729
2005/0254778 A1 * 11/2005 Pettersen ..... H04R 1/44 386/333
2006/0009970 A1 * 1/2006 Harton ..... 704/231
2006/0009971 A1 * 1/2006 Kushner ..... G10L 17/26 704/231
2006/0020451 A1 * 1/2006 Kushner ..... B63C 11/26 704/226
2007/0086273 A1 * 4/2007 Polany ..... H04R 1/021 367/131
2007/0254591 A1 * 11/2007 Nassimi ..... H04L 1/22 455/63.3
2013/0121113 A1 * 5/2013 Imran ..... G10L 21/0364 367/132
2013/0156246 A1 * 6/2013 Menyhart ..... A62B 18/08 381/367
2013/0288596 A1 * 10/2013 Suzuki ..... H04B 11/00 455/40
2014/0190476 A1 * 7/2014 Stinton ..... A62B 17/04 128/201.23
2015/0071039 A1 * 3/2015 Rahkonen ..... H04B 11/00 367/134
2015/0217143 A1 * 8/2015 Palmer ..... A62B 18/08 128/202.27
2016/0005232 A1 * 1/2016 Quarles ..... G06F 3/16 345/633
2016/0127716 A1 * 5/2016 Ramiro ..... G06F 1/163 348/53
2017/0096204 A1 * 4/2017 Cucchia ..... B63C 11/16
2018/0134352 A1 * 5/2018 Armani ..... B63C 11/16
2020/0132463 A1 * 4/2020 Gauthier ..... G01C 21/20

FOREIGN PATENT DOCUMENTS

JP 03068226 A * 3/1991
JP 2003244734 A * 8/2003
KR 20020088292 A * 11/2002
KR 101576117 B1 * 12/2015 ..... A63H 33/26
WO WO-9803225 A1 * 1/1998 ..... A62B 18/08
WO WO-02055379 A2 * 7/2002 ..... B63C 11/12
WO WO-2013085266 A1 * 6/2013 ..... A62B 18/086
WO 2016/170253 A1 10/2016
WO WO-2016170253 A1 * 10/2016 ..... B63C 11/26
WO WO-2018208838 A1 * 11/2018 ..... B63C 11/205

* cited by examiner

MASK FOR UNDERWATER USE, IN PARTICULAR OF THE FULL FACE TYPE, PROVIDED WITH A COMMUNICATION DEVICE

CROSS REFERENCE TO RELATED APPLICATIONS

This Application claims priority to Italian Patent Application No. 102017000090078 filed on Aug. 3, 2017, the disclosure of which is herein incorporated by reference in its entirety.

FIELD OF THE INVENTION

The present invention relates to a mask for underwater use, in particular of the full face type provided with a mouthpiece to enable the wearer to breathe with his/her head under the surface of the water, provided with a communication device.

BACKGROUND OF THE INVENTION

Masks for underwater use, also known as diving masks, comprise a part or frame made of rubber or silicone that adheres to a user's face by means of at least one belt that is wound around the user's head and at least a transparent part, generally made of glass or plexiglass, able to allow underwater vision and to negate the refraction phenomenon that causes blurred vision underwater. The glass and the rubber frame isolate at least partly in a water-proof manner from the underwater environment, allowing a correct vision.

In underwater activities, two types of mask are widely used in particular: a first one that covers eyes and nose, and a second one known as full face mask, that covers the entire face, mouth included. This second type of mask comprises a transparent visor, a frame or strapping, a seal made of rubber adapted to ensure the water-tight seal and suitable straps to fit the mask on the face. Such a face part of the mask is associated with a breathing mouthpiece that engages on the upper part of the frame and that allows the flow of air to enter into the compartment made between the frame and the visor.

The path of the air during the breathing-in phase and that during the breathing-out phase are advantageously different from each other.

For this purpose, inside the mask are obtained two compartments, a main upper one in the area of the eyes and cheekbones of the user and an oronasal one that is associated with the user's nose and mouth. These compartments are separated by a separating wall provided with air valves.

The inhaled fresh air reaches, through the tube, the main compartment of the mask, flows over the transparent part or visor, traverses the wall through the aforementioned valves and reaches the oronasal compartment to be breathed.

The air exhaled from the mouth or from the nose does not exit the oronasal compartment, because the valves on the separating wall prevent it, but reaches the tube through a peripheral exhalation duct of the mask.

The tube itself being made with separate ducts for the air breathed in and out provided with appropriate directional valves.

In this way, the known drawback of the fogging over of the mask, because only the fresh air coming from outside flows over the transparent part while the exhausted one exits the mask without passing in the facial area thereof.

A mask of this type is described in the patent application EP3153400 in the name of the same applicant.

Providing such masks with a communication device is also known, for example as described in the patent application WO2016170253. In particular, said patent application describes a full face mask whereon is installed a communication device at least partly mounted on the tube.

The communication device comprises at least a microphone, a loudspeaker, an ultrasonic antenna and a command button panel.

Said device is characterised in that it has a removable connector that is interposed between the strapping (or frame) of the mask and the base of the tube. On said removable connector is present at least the communication device and in particular at least one loudspeaker of the device.

In this way, removing the connector by separating the tube from the frame, it is possible fully to remove the device from the mask, or it is possible to equip a standard mask of the full face type with a communication device through said removable connector.

The applicant has observed that this assembly procedure can be laborious and complicated, and in that case, the connector may damage both the tube and the frame of the mask.

With the present invention, the applicant proposes an improvement of the positioning of the communication device which also simplifies the manufacture and the assembly of the mask.

SUMMARY OF THE INVENTION

These and other purposes according to the present invention are achieved by a diving mask as set forth in claim 1.

Further features of the diving mask are the subjects of the dependent claims.

BRIEF DESCRIPTION OF THE DRAWINGS

The features and advantages of a diving mask according to the present invention will be more readily apparent from the following exemplifying and non-limiting description, referred to in the accompanying schematic drawings, wherein.

DETAILED DESCRIPTION OF THE INVENTION

Figure 1:
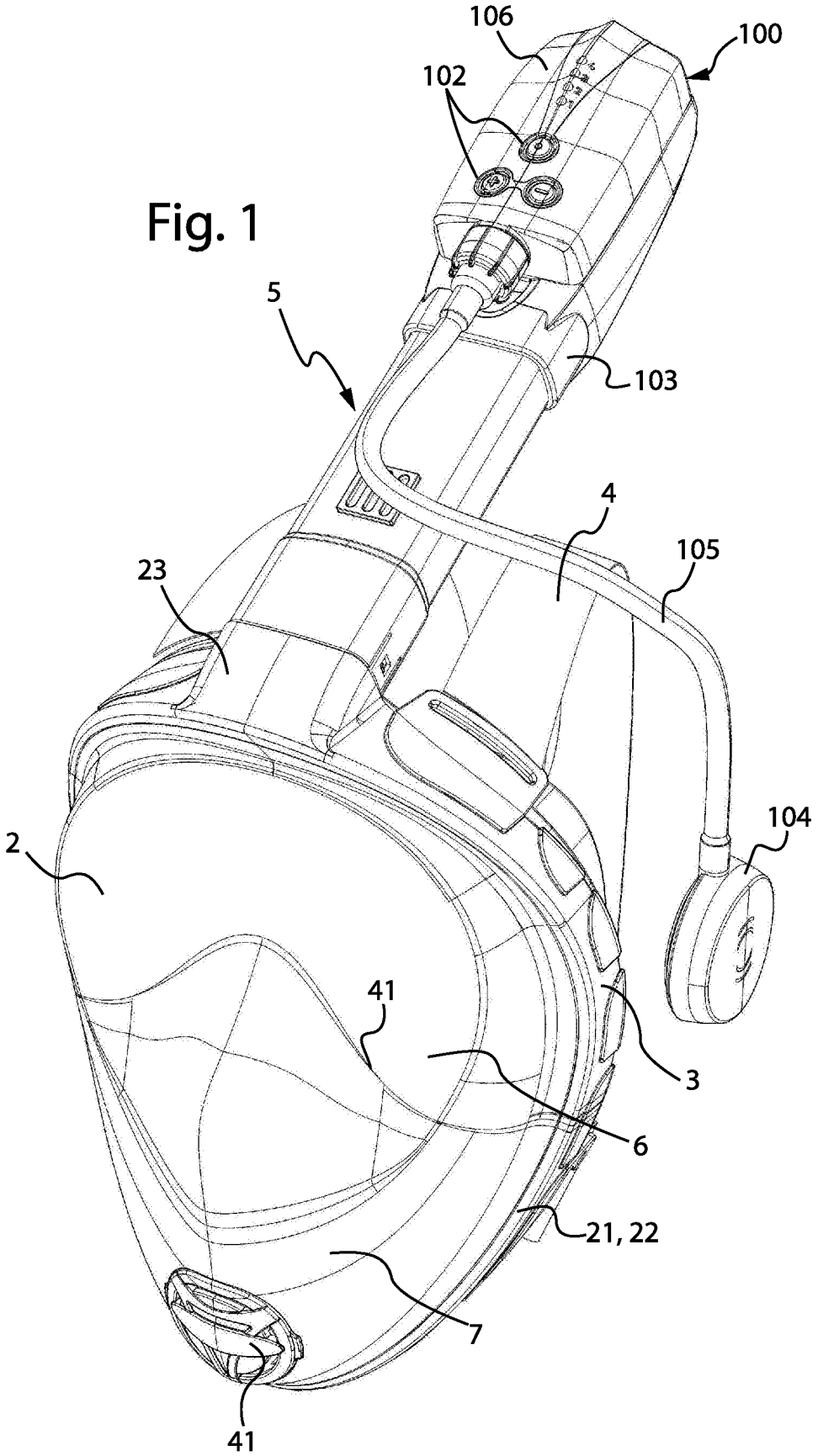
FIG. 1 is a perspective view of a diving mask according to the present invention, in particular of the full face type.
Figure 2:
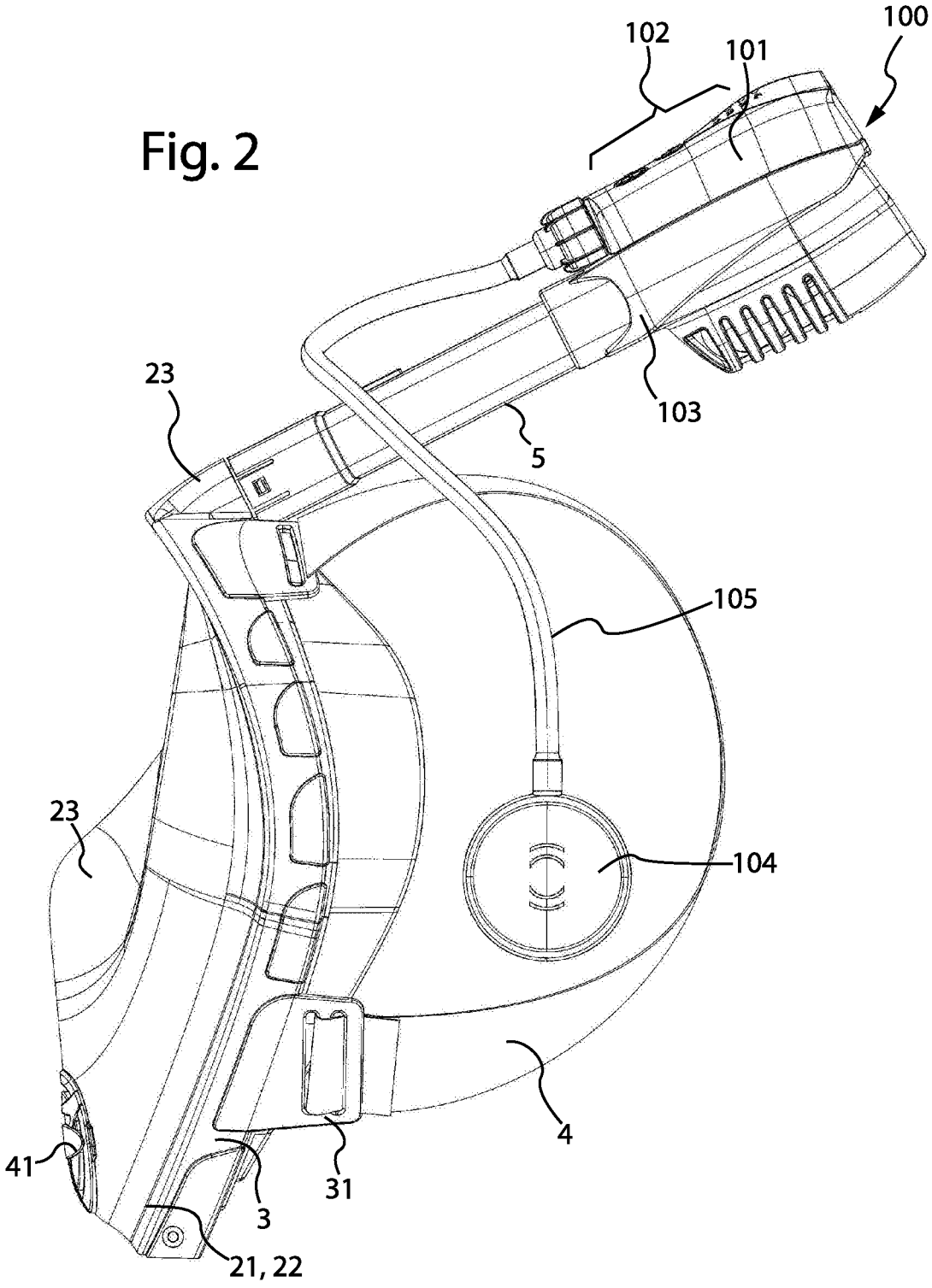
FIG. 2 is a lateral view of a diving mask according to the present invention, in particular of the full face type.
Figure 3:
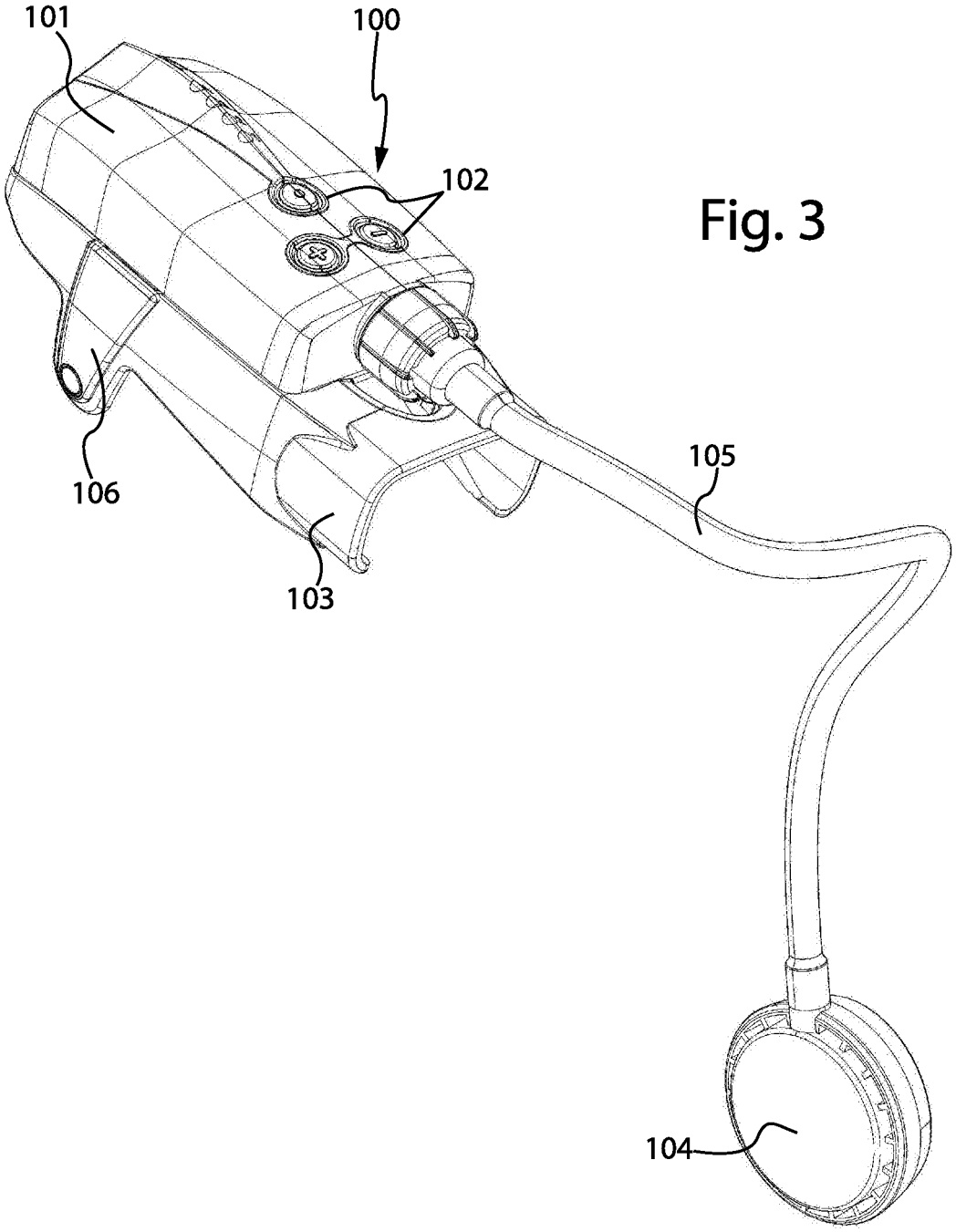
FIG. 3 is a perspective view of the communication device of the mask according to the present invention.

With reference to the aforementioned figures, a diving mask of the so-called full face type is shown which comprises a transparent visor 2, a frame or strapping 3, a seal preferably made of rubber able to ensure the water-tight seal and suitable straps 4 to fit the mask on the face.

Said face part of the mask is associated with a breathing tube 5 that engages on the upper part of the mask and that allows the flow of air to enter into the compartment made between the frame and the visor.

The path of the air during the breathing-in phase and that during the breathing-out phase both in the mask and in the tube are advantageously different from each other.

The tube for this purpose is made with separate ducts for the air breathed in and out.

Preferably, the inhalation duct is placed in a central position, and there are two exhalation ducts positioned to the side of the central inhalation duct.

Substantially on the top of these ducts are positioned one-way valves (not shown) that allow the passage of air only in the desired direction.

Also for the purpose of creating differentiated paths inside the mask are obtained two compartments, a main upper one 6 in the area of the eyes and cheekbones of the user and an oronasal one 7 that is associated with the user's nose and mouth.

Said compartments are separated by a separating wall 41, made in association with the seal and provided with at least one housing for at least one one-way valve for the passage of air from the main compartment to the oronasal compartment. Advantageously, there are two valves arranged laterally in a symmetrical position with respect to a vertical centreline plane which traverses the mask.

On said centreline plane in a lower portion of the oronasal compartment is obtained a valve 41 for the outflow of liquid from the aforesaid compartment if water were inadvertently penetrated inside the mask.

The inhaled fresh air reaches, through the tube, the main compartment of the mask, flows over the transparent part or visor, traverses the wall through the aforementioned valves and reaches the oronasal compartment to be breathed.

The air exhaled from the mouth or from the nose does not exit the oronasal compartment, because the valves on the separating wall prevent it, but reaches the tube according to the present invention through a peripheral exhalation duct of the mask.

Said path comprises a pair of peripheral channels 21 and 22 obtained on the edge of the visor, preferably substantially "U" shaped which, when the visor is associated to the seal, are closed by a flat annular edge of the seal, forming as many peripheral ducts for the exhaled air. These channels extend from the top of the visor where coupling means are present for coupling the mask to the tube, made in the form of a housing 23 for the engagement of said tube, to beyond the position in which the separating wall 41 between the two compartment joins the visor itself. This is to prevent the exhalation ducts from communicating with the first compartment.

The means for coupling the mask with the tube also determine the coupling of the respective exhalation ducts of the tube and of the mask. The inhalation duct of the tube ends directly in the main upper compartment 6.

The channel obtained in the visor and closed by the seal is a substantially non-deformable channel; this ensures an optimal outflow of the exhaled air in any condition and regardless of the size of the user's face.

Moreover, both the channel and the engagement for the tube are obtained in the visor, this determines an ease of construction of the strapping which becomes a simple loop, provided only with clasps 31 for the belts 4 which maintains the assembly of the mask. The only complex element to be manufactured in the mask remains the visor, which however can conventionally be moulded, avoiding the gas insufflation procedure which in known masks was used to manufacture the channel in the seal.

According to the present invention, this mask and full face masks, in general, having similar characteristics can be associated with a communication device 100 which comprises a main body 101 provided with electronic board and preferably with a command button panel 102. The main body has clamping means at the top of the tube 6 comprising an open sleeve 103 which clamps in a snap-fit manner on said tube. On the main body is present a microphone that is advantageously positioned in proximity of the exhalation duct of the tube, in particular in proximity to its upper end. In this way, it is easier for the microphone itself to detect the voice vibrations coming from the exhalation duct. Moreover, the microphone is advantageously encapsulated into the body 100 and protected by a speech diaphragm which allows to capture the sound wave coming from the tube (from the lateral exhalation segments of the tube) through a conveyor 106 obtained laterally on the body. The diaphragm isolates from the water the electronics present in the body and is concurrently able to capture with its vibration the audio and to transfer it inside, where the microphone is present.

On this body is also provided an antenna adapted to communicate with devices of the same type mounted on other masks.

Preferably, four communication channels are provided with as many frequencies that can be selectively operated.

An earpiece 104 is connected to said main body through a flexible tube 105, so as to be able to position the earpiece itself indifferently on the right or on the left ear. The tube 105 is flexible but semi-rigid, and hence it can be modeled to be positioned in the most suitable point without creating inconveniences with attachments that would act on the auricle.

Inside the main body is also present a rechargeable battery. The flexible tube of the earpiece is connected to the main body in a removable manner (for example through a bayonet coupling and micro USB plug), so as to be able to charge the battery of the main unit, for example through the same micro USB plug.

The button panel preferably comprises three buttons, respectively on/off button, volume increase button V+ and volume decrease button V−.

Moreover, on the body are provided a plurality of light indicators 106, for example, four LEDs which can indicate, respectively, the channel selected when the unit is on.

For example, they can flash in series three times when the unit is turned on, indicate the level of the listening volume only for the duration of the pressure on the button.

They also indicate the charging status of the battery when the V+ and V− buttons are pressed simultaneously when the unit is on. Lastly, they flash in series continuously when the unit is being charged, and they turn off when the charging is completed.

We claim:

1. A diving mask of the so-called full face type comprising a transparent visor, a frame or strapping, a sealing skirt adapted for ensuring a water-tight seal and suitable straps to fit the mask on a face, wherein:

a face part of the mask is associated with a breathing tube that engages on an upper part of the mask and allows the flow of air to enter into a compartment made between the frame and the visor, a path of air being breathed in and that being breathed out, both in the mask and in the breathing tube, being different from each other, the breathing tube comprising separate ducts for the air breathed in and out, and the inside of the mask comprising two compartments, one upper front and one lower oronasal, separated by a separating wall, the path inside the mask provides for the air breathed in to be introduced from the breathing tube into the front compartment and then into the oronasal compartment, and the air breathed out from the oronasal compartment travels up to the breathing tube, and wherein said diving mask comprises a communication device comprising:

a) a main body equipped with an electronic board and a clamping means comprising an open sleeve that clamps in a snap-fit manner on top of the breathing tube, b) a microphone on the main body, which is positioned in proximity to the upper end of the duct for air breathed out of the breathing tube, c) an earpiece connected to said main body through a flexible tube, and d) an antenna on the main body, adapted to communicate with devices of the same type mounted on other diving masks.

2. The diving mask according to claim 1, wherein the microphone is integrated into the main body and protected by a speech diaphragm which allows capture of the sound waves coming from the breathing tube through a conveyor positioned laterally on the main body.

3. The diving mask according to claim 1, further comprising a command button panel on the main body.

4. The diving mask according to claim 1, further comprising a rechargeable battery inside the main body.

5. The diving mask according to claim 1, wherein the flexible tube of the earpiece is connected to the main body in a removable manner through a bayonet coupling and micro USB plug, so that the battery inside the main body is chargeable through the same micro USB plug.

6. The diving mask according to claim 1, further comprising a plurality of light indicators on the main body.

7. The diving mask according to claim 3, wherein the command button panel comprises at least three buttons: on/off button, volume increase button (V+) and volume decrease button (V−).

8. The diving mask according to claim 6, further comprising a number of selectively operable communication channels having selected frequencies, wherein said light indicators comprise LEDs which indicate the communication channel selected when the unit is on.

* * * * *